US005323968A

United States Patent [19]

Kingston et al.

[11] Patent Number: 5,323,968

[45] Date of Patent: Jun. 28, 1994

[54] WATER SPRAY GUN

[75] Inventors: Jonathan F. M. Kingston, Monks Risborough; Robert D. Boughton, Linden Village, both of United Kingdom

[73] Assignee: Hozelock Limited, United Kingdom

[21] Appl. No.: 934,182

[22] Filed: Aug. 21, 1992

[30] Foreign Application Priority Data

Aug. 29, 1991 [GB] United Kingdom ..... 9118510

[51] Int. Cl.[5] ..... B05B 7/06

[52] U.S. Cl. ..... 239/449; 239/526

[58] Field of Search ..... 239/443–449, 239/526, 581.1

[56] References Cited

U.S. PATENT DOCUMENTS

| | | | |
|---|---|---|---|
| 236,541 | 1/1881 | Broughton | 239/449 |
| 2,359,455 | 10/1944 | Williamson | 239/449 |
| 2,766,771 | 10/1956 | Wenzel | 251/304 X |
| 2,801,882 | 7/1959 | Schwemlein | 239/443 X |
| 2,981,284 | 4/1961 | Putnam | 239/581.1 X |
| 4,618,100 | 10/1986 | White et al. | 239/447 X |
| 4,909,443 | 3/1990 | Takagi | 239/526 X |
| 4,955,546 | 9/1990 | Liaw | 239/449 X |
| 5,033,897 | 7/1991 | Chen | 239/447 X |
| 5,145,114 | 9/1992 | Monch | 239/447 X |

FOREIGN PATENT DOCUMENTS

| | | | |
|---|---|---|---|
| 0211122 | 2/1987 | European Pat. Off. . | |
| 503790 | 5/1928 | Fed. Rep. of Germany | 239/449 |
| 11121 | of 1888 | United Kingdom | 239/449 |

*Primary Examiner*—Andres Kashnikow
*Assistant Examiner*—Kevin P. Weldon
*Attorney, Agent, or Firm*—Lee, Mann, Smith, McWilliams, Sweeney & Ohlson

[57] ABSTRACT

A water spray gun has a barrel, the front of which includes a nozzle which is operable to eject water in a chosen one of a number of different patterns. At the rear of the barrel there is provided a handle having a passage for water supplied to the gun. The admission of water through the handle and thence into the barrel is controlled by a trigger which is squeezable against the handle. In use, the pattern of water ejected by the nozzle is selected using a rotatable valve member within the rear end of the barrel. The annular position of the valve member is selected using a control element at the rear end of the barrel. The valve directs water either to a central passage or to an outer annular passage extending through the barrel to feed water to respective alternative areas of the nozzle.

10 Claims, 6 Drawing Sheets

10
12
14
16
18
20
22
24
26
28
30
32
34
38
42
43
46
48
50
52
58
66
80
82
84
A
B 26
62
34
32
60
10
76
74
72
64
82
48
58
66
84
24
52
30
68
40
80
78
14
18
20
A
B
C
70
28
66
40
10

WATER SPRAY GUN

FIELD OF THE INVENTION

This invention relates to a water spray gun intended for horticultural use.

The term "water spray gun", as used herein, refers to a water spraying device assuming the general form of a hand pistol, comprising a barrel from the front end of which water is ejected through a nozzle means and a handle communicating with the barrel and through which water is admitted via a valve controllable by a trigger which can be squeezed towards the handle. Such a device is hereinafter referred to as a water spray gun of the kind described.

BACKGROUND TO THE INVENTION

Various water spray guns are known which incorporate means for varying the pattern taken by the water ejected from the nozzle means at the front end of the barrel. Usually, this variation is achieved by adjustment of said nozzle means or valve means associated therewith at the front end of the barrel.

THE INVENTION

According to the present invention, there is provided a water spray gun of the kind described wherein the pattern of water ejected through a nozzle means at the front end of the barrel is adjustable by a control element at the rear end of the barrel.

Preferably, the pattern of the ejected water is adjustable between a spray and a generally unidirectional jet.

In order to provide said alternative patterns of the ejected water, the nozzle means at the front end of the barrel may conveniently comprise a central jet-producing aperture and a surrounding spray-producing perforated plate.

Preferably, the jet-producing aperture and the spray-producing perforated plate are fed with water through separate passages contained within the barrel, conveniently a central passage for the jet-producing aperture and a surrounding principally annular passage for the spray-producing perforated plate.

Access of water to the rear ends of the two passages, from the handle through which water can be admitted to the gun under trigger control, is preferably achieved by means of a movable valve member displacement of which is controlled by the aforesaid control element at the rear end of the barrel.

According to another aspect of the invention, therefore, there is provided a water spray gun of the kind described in which the pattern of water ejected through a nozzle means at the front end of the barrel is adjustable by means of a valve member which is displaceable under the control of a control element at the rear end of the barrel selectively to admit water to either one of two passages which respectively feed water to different parts of the nozzle means.

The control element is preferably rotationally adjustable to control displacement of the movable valve member.

In a preferred embodiment, the control element is integrally formed with the valve member, so that the valve member is also rotatable selectively to admit water to either one of the two aforesaid passages.

One convenient construction of valve member comprises a hollow stem carrying an oblique oval flange, preferably provided around its periphery with a sealing ring, which seals against the inside of the barrel and, when the valve member is rotated, is so changed in inclination that its peripheral sealing face traverses the port at which water is admitted to the barrel from the handle, whereby in a first inclination to admit water into the hollow stem and thus feed water to the central passage in the barrel leading to the jet-producing aperture of the nozzle means and in a second inclination to admit water to a chamber within the barrel which communicates with the outer passage in the barrel leading to the spray-producing perforated plate of the nozzle means. With such a construction of valve member, a change from a water jet to a spray and vice-versa can be accomplished with only a relatively small angular rotation of the control element, conveniently less than 180 degrees. The two operative positions of the control element are preferably defined by a stop means formed on the valve member and the interior of the barrel. Generally midway between these two operative positions, the oblique sealing flange lies across the entry port from the handle but a small amount of water is still admitted to both passages. The oblique sealing flange may alternatively seal the entry port in this intermediate position.

In the preferred embodiment, the front end portion of the barrel is formed with an outer tubular part and inner tubular part, the inner passage leading to the jet-producing aperture of the nozzle means being defined within the inner tubular part and the outer passage leading to the spray-producing perforated plate of the nozzle means being defined between the two tubular parts. At its rear end, the inner tubular part of the barrel preferably acts as a sealed bearing for a front end portion of the stem of the valve member. In the region of this bearing, the rear end of the inner tubular part is externally stepped to form a rear terminal portion of increased diameter at which the inner tubular part is joined to the outer tubular part, and said portion of increased diameter is apertured to permit water flow into the outer passage between the two tubular parts. Moreover, behind said rear terminal portion of the inner sleeve, the valve stem has a region of increased diameter at which the valve member is located against axial displacement in the barrel, and said increased diameter region of the valve member is also apertured to permit forward water flow, from the afore-mentioned chamber in the barrel behind it, into an intermediate space from which the water can enter the apertures in the increased diameter portion of the inner tubular part of the barrel.

The nozzle means preferably also comprises an inner tubular part and an outer tubular part, said inner tubular part fitting, by means of cooperating screwthreads, over the front end of the inner tubular part of the barrel and said outer tubular part fitting sealingly within the outer tubular part of the barrel.

DESCRIPTION OF EMBODIMENT

Further features of the water spray gun in accordance with the invention will be apparent from the following description of a practical embodiment, making reference to the accompanying drawings, in which.

Figure 1:
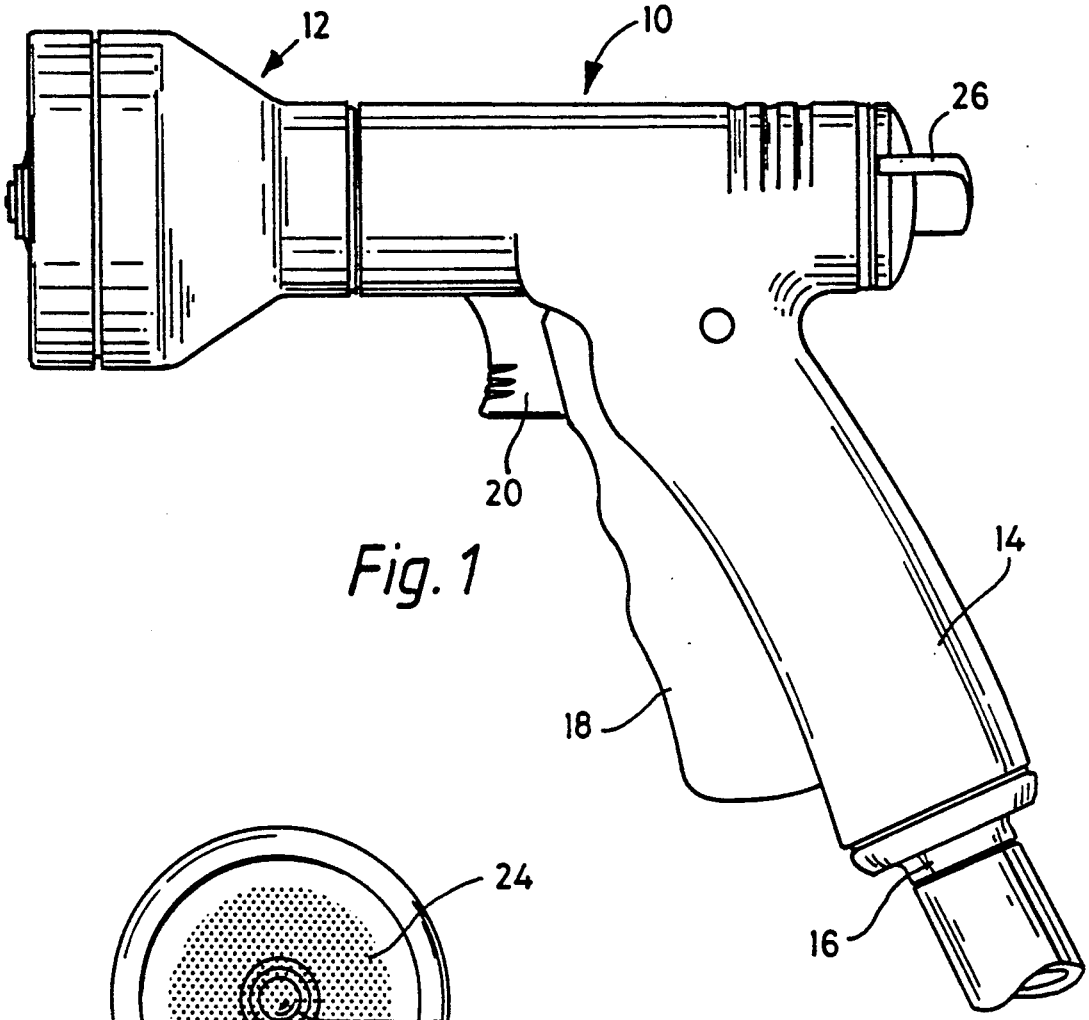
FIG. 1 is a side elevational view of the spray gun, FIGS. 1A and 1B being partial front and rear elevational views, respectively.

Referring first to FIG. 1, the illustrated water spray gun, moulded of plastics material, has a barrel 10 which is fitted with a nozzle means 12 at its front end and adjacent its rear end is united with a handle 14 through which passage of water under pressure entering the handle through an inlet 16 is controllable by a trigger 18. The trigger acts in a conventional manner to open and close a valve (not shown) housed within the handle 14, so that when the trigger 18 is squeezed towards the handle, water under pressure passes through the handle to enter the barrel 10 and thence be fed forwardly along the barrel to be ejected at the nozzle means 12. The trigger 18 can be locked in the squeezed position by a locking element 20.

Figure 1A:
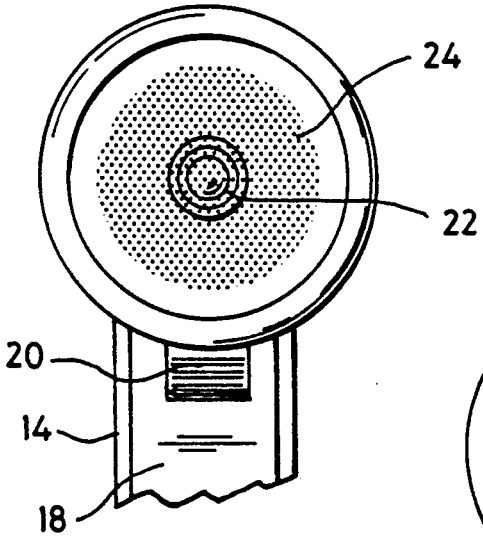
Figure 1B:
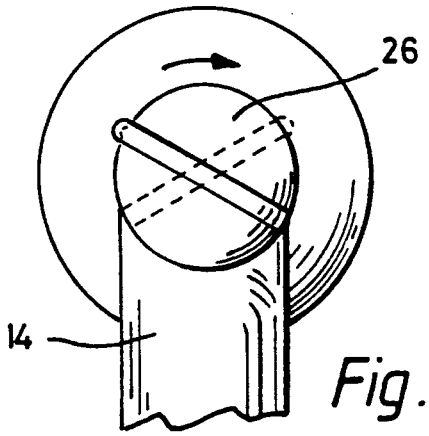

The nozzle means 12 (FIG. 1A) has a central annular aperture 22 for ejecting a generally unidirectional jet of water and a surrounding, perforated metal plate 24 for ejecting water in a spray pattern. The pattern of water to be ejected (jet or spray) is selectable by means of a control knob 26 (see FIG. 1B) at the rear end of the barrel 10. The manner in which this is accomplished is described in detail with reference to the subsequent figures of drawings.

Figure 6A:
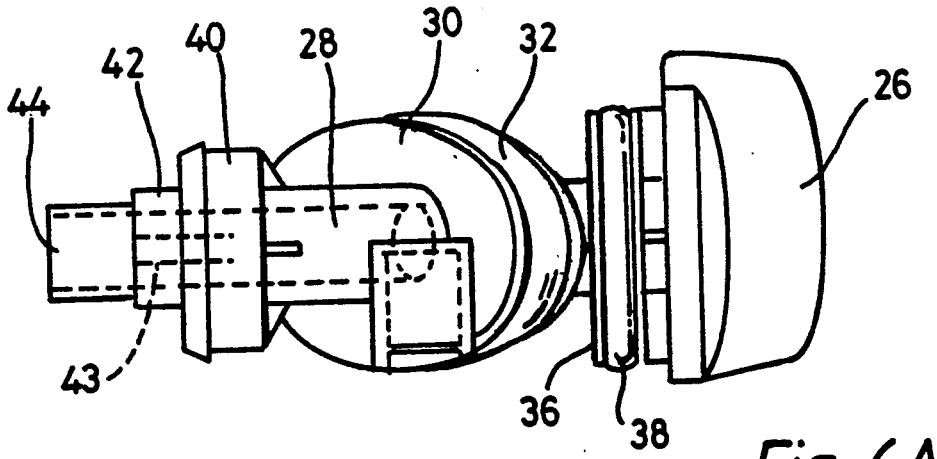
FIGS. 6A and 6B are side elevational views of the valve member, respectively seen from directions at right angles with one another, FIG. 6C being a scrap view.
Figure 6B:
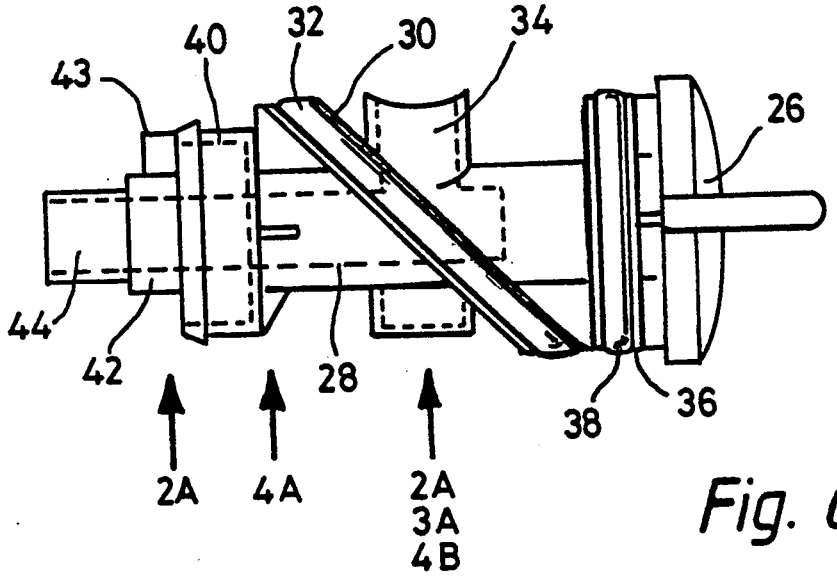
Figure 6C:
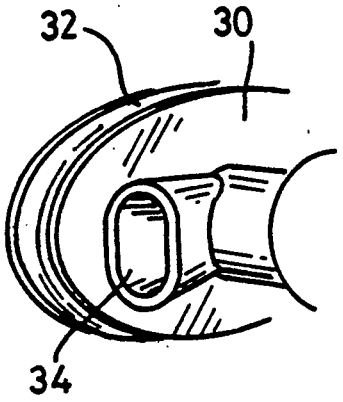

The rear portion of the barrel 10 houses a plastics-moulded valve member (shown separately in FIG. 6) which has a hollow stem 28 integrally formed with the control knob 26 at its rear end. The hollow stem 28 carries an oblique oval flange 30 having a grooved peripheral face in which is seated an O-ring 32. A water inlet tube 34 (see FIG. 6C) projects laterally from the hollow stem 28 and communicates with the interior of the latter. Also integrally formed as parts of the moulded valve member are a rear circular flange 36 carrying an O-ring 38 and a region 40 of increased diameter in front of the oblique oval flange 30. In front of the region 40 the stem has a region 42 with a lateral projection 43 which in use constitutes a rotational abutment and, in front of the region 42, the valve member has a front end portion 44 of reduced diameter. The arrows in FIG. 6B indicate the positions of cross-sectional views to be seen in FIGS. 2A, 4A, 2B, 3A and 4B.

Figures 2, 2A, 2B:
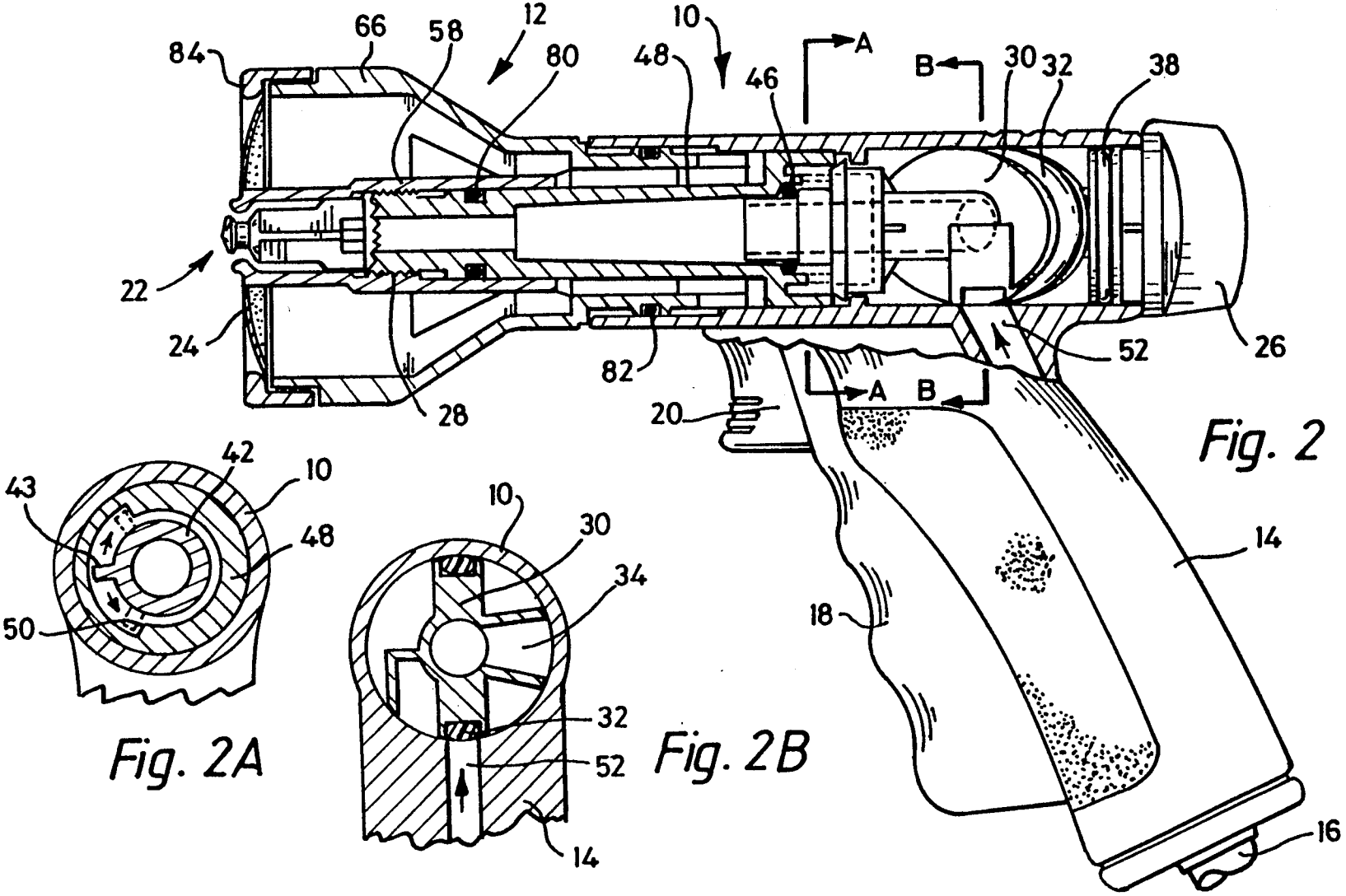
FIG. 2 is a longitudinal cross-sectional view of the gun in an intermediate position of a valve member, FIGS. 2A and 2B being transverse cross-sections on the lines A—A and B—B of FIG. 2, respectively.

FIG. 2 shows the valve member assembled within the rear portion of the barrel 10. Within this rear portion of the barrel the valve member is rotatable by turning the control knob 26, between two operative positions. In FIG. 2 the valve member is shown in an intermediate position generally midway between the two operative positions. The valve member rotates within the barrel between bearings constituted by the above-mentioned O-ring 38 and an O-ring 46 carried by the rear end portion of an inner tubular part 48 of the front portion of the barrel 10. Additionally, the valve member also bears against the interior of the barrel 10 at the O-ring 32 carried by the oblique flange 30.

The two operative angular positions of the valve member are defined by cooperation of the above-mentioned lateral projection 43 at the region 42 of the stem of the valve member with stops 50 formed on the interior of the rear end portion of the inner tubular part 48 of the front portion of the barrel 10, as will be clear from FIG. 2A.

In the intermediate angular position of the valve member shown in FIG. 2, the O-ring 32 around the periphery of the oblique flange 30 lies across (but does not completely seal) a water entry port 52 from the handle 14 into the barrel 10, as is also shown in FIG. 2B. Thus, in this intermediate position, the gun is not operative to produce either a water jet or a spray, even with the trigger 18 squeezed. Normally, however, the control knob 26 will only be turned to rotate the valve member through this inoperative position, and not stop the valve member in this position.

Figures 3, 3A:
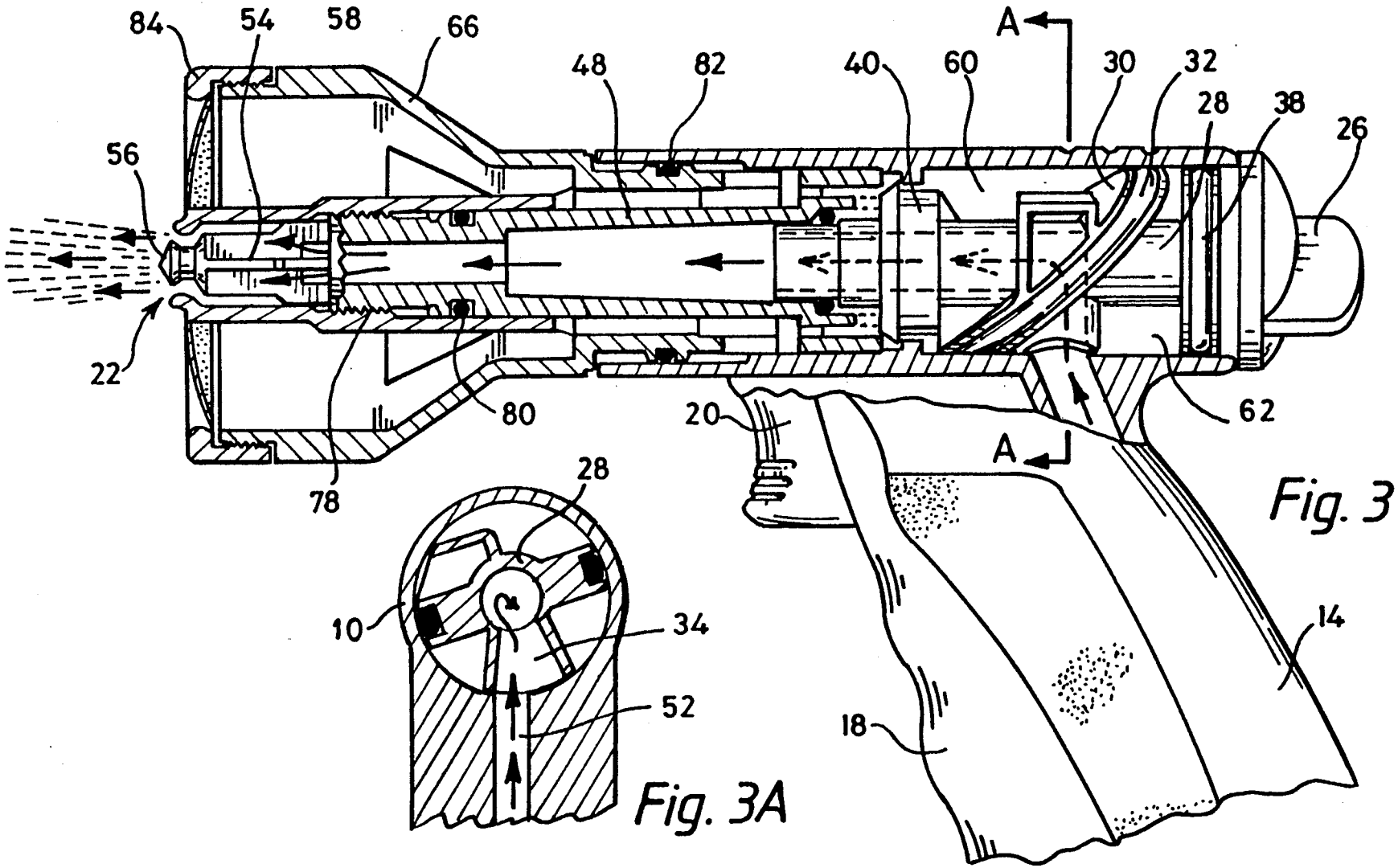
FIG. 3 is a similar longitudinal cross-sectional view of the gun in a first operative position of the valve member, FIG. 3A being a transverse cross-section on the line A—A of FIG. 3.

FIG. 3 shows the valve member turned to a first operative position, in order to produce a water jet at the nozzle means. In this position, the inlet tube 34 is aligned with the entry port 52, as also shown in FIG. 3A, so that water enters the hollow stem of the valve member and is directed forwardly into the inner tubular part 48 of the front portion of the barrel. This inner part 48 of the front portion of the barrel carries at its front end a cruciform-shaped extension 54 with a head 56 at its front end which cooperates with an inner tubular part 58 of the nozzle means 12 to define the central aperture 22 through which a water jet is ejected.

In this first operative position, the O-ring 32 of the oblique flange 30 of the valve member seals against entry of water into the chamber 60 immediately behind the enlarged region 40 near the front end of the stem 28 of the valve member. Water can leak into the chamber 62 to the rear side of the oblique flange 30, but this chamber is sealed against water leakage from the rear end of the barrel by the O-ring 38.

Figures 4, 4A, 4B, 4C:
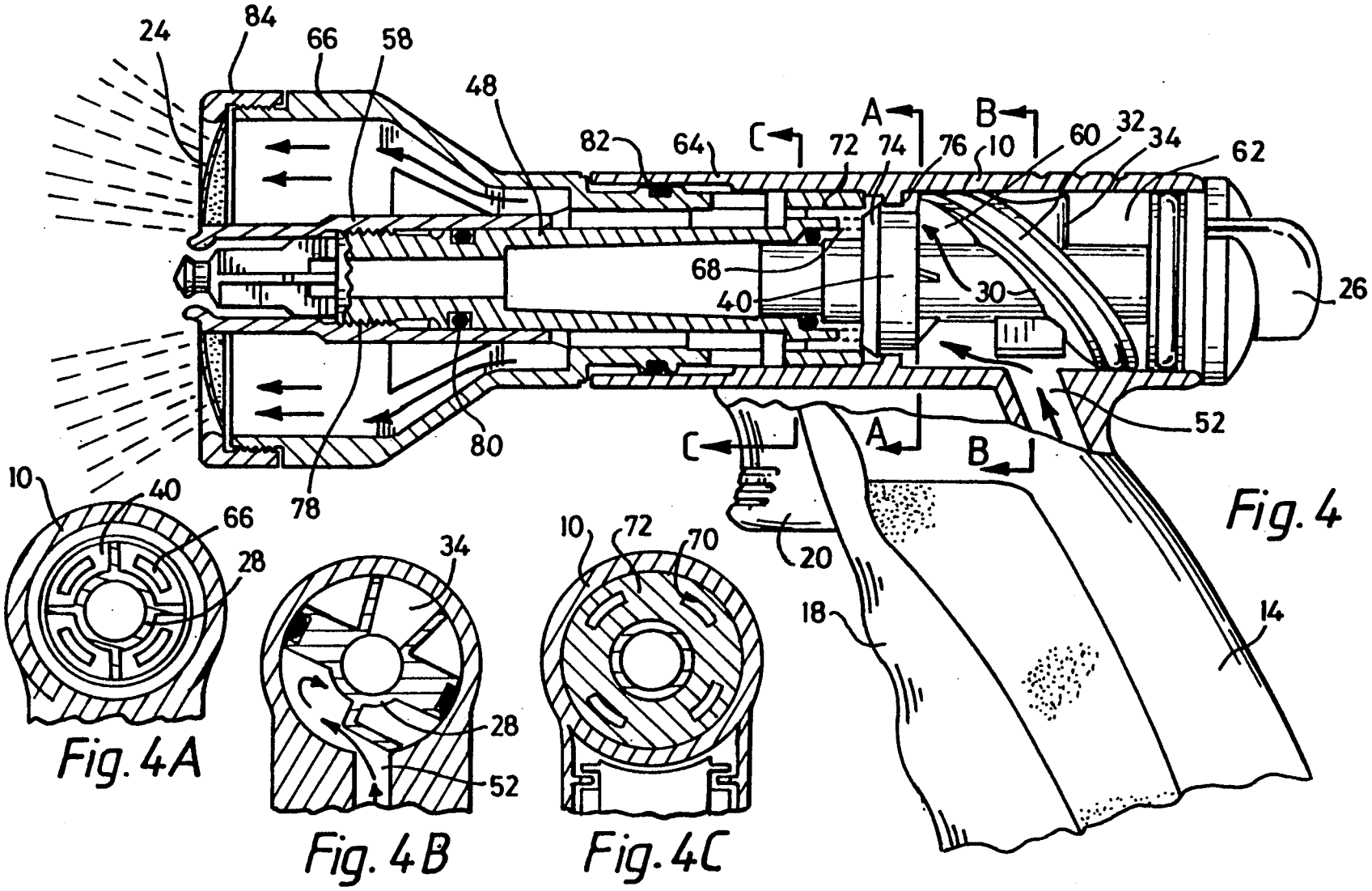
FIG. 4 is another longitudinal cross-section through the gun, with the valve member in a second operative position, FIGS. 4A, 4B and 4C being transverse cross-sections on the lines A—A, B—B and C—C of FIG. 4, respectively.
Figure 5:
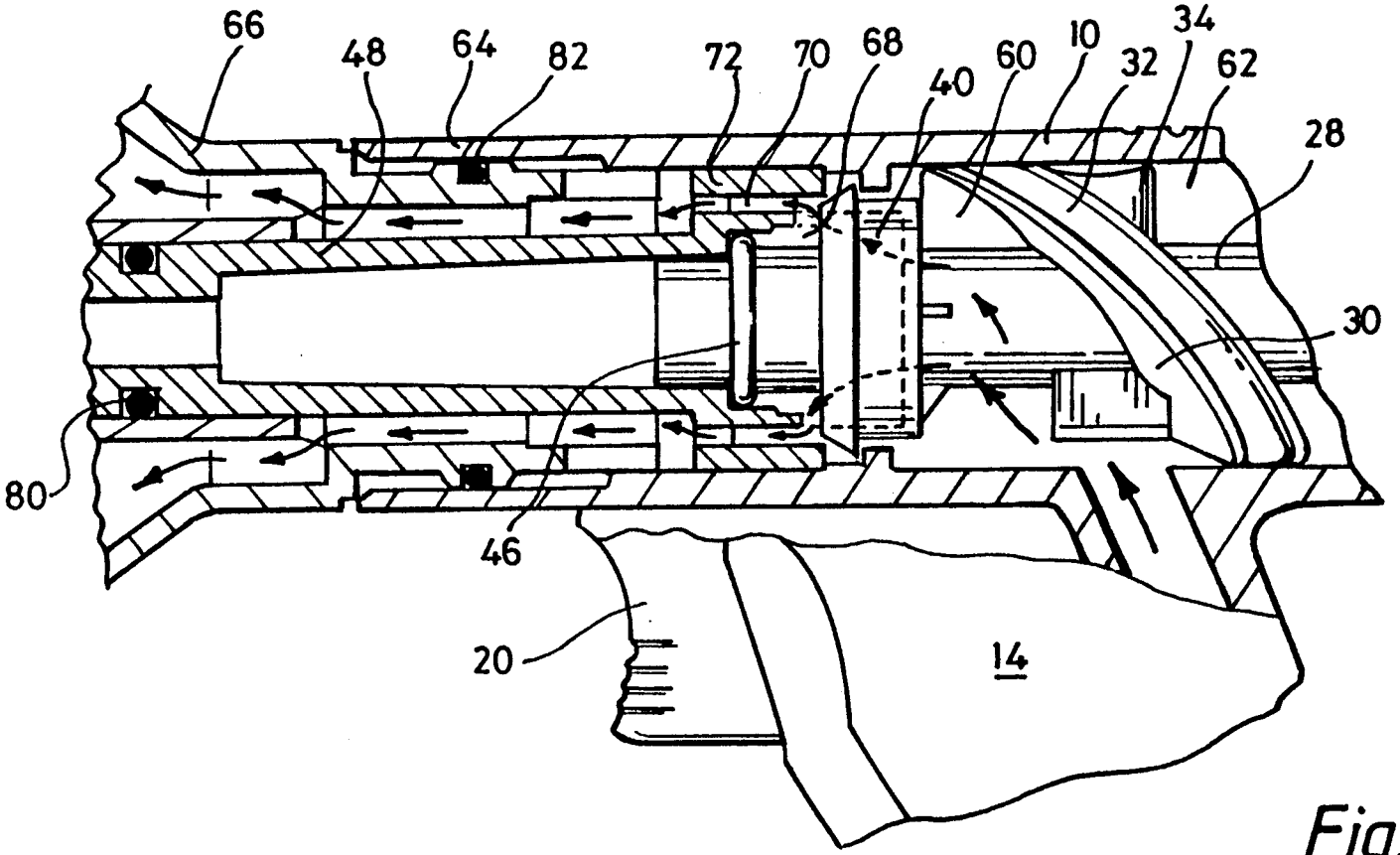
FIG. 5 is an enlargement of part of the longitudinal cross-sectional view of FIG. 4.

In the second operative position of the valve member, shown in FIG. 4 and in enlargement in FIG. 5, the oblique flange 30 has been rotated through about 140 degrees by use of the control knob 26, this opening the above-mentioned chamber 60 to entry of water from the port 52, as also indicated in FIG. 4B. The O-ring 32 on the oblique oval flange 30 now seals the chamber 62 against entry of water, so that water cannot access the rotationally displaced inlet tube 34.

Thus, water is able, as described below, to pass into the space between an outer tubular part 64 of the front portion of the barrel and the above-mentioned inner tubular part 58, thereby to be ejected as a spray through the perforated plate 24, which is carried by an outer tubular part 66 of the nozzle means.

Communication between the chamber 60 and the passage between the inner and outer tubular parts 48, 64 of the barrel is by way of slots 66 in the increased diameter region 40 of the valve member (see FIG. 4A), which slots lead to an intermediate space 68, from which slots 70 formed in an externally enlarged rear end portion 72 of the inner tubular part 48 of the front portion of the barrel (see FIG. 4C), at which said inner tubular part 48 unites with the outer tubular part 64, lead forwardly to open into the passage between the two tubular parts 48, 64. The increased diameter portion 40 of the stem 28 of the valve member is lipped, as indicated at 74, to locate in front of an internal annular projection 76 on the rear portion of the barrel, thereby to hold the valve member against axial displacement in the barrel.

FIGS. 2 to 4 also show that the nozzle means, which has the above mentioned inner and outer tubular parts 58, 66, releasably attaches by means of cooperating screwthreads 78 to the inner tubular part 48 of the barrel, sealing being accomplished by an O-ring 80, and the outer tubular part 66 of the nozzle carrying an O-ring 82 which seals against the interior surface of the outer tubular part 64 of the front portion of the barrel. The perforated plate 24 for producing a spray is carried by a cap 84 which is fixed to the outer tubular part 66 of the nozzle means.

Various modifications of the above-described and illustrated arrangement of water spray gun are possible within the scope of the invention hereinbefore defined, especially in respect of the construction and arrangement of the valve member.

We claim:

1. A water spray gun comprising a barrel having a front end and a rear end; nozzle means at said front end and having two different water discharge areas; selectable direction means for selectively directing the water to at least a chosen one of said two different water discharge areas so as to select a pattern of water discharged by the nozzle means, said selectable direction means comprising two water flow passages in the barrel and a control element disposed at the rear end of the barrel and operative to select the water flow passage to which the water is directed; a handle having an internal passage for supplying water to the barrel; and a trigger member movable with respect to the handle to control the flow of water to the barrel through the handle.

the front end of the barrel is formed with an outer tubular part and an inner tubular part, the water flow passages comprising an inner passage, leading to a jet-producing aperture means of the nozzle means, defined within the inner tubular part and an outer passage, leading to a spray-producing perforated plate of the nozzle means, defined between the two tubular parts;

the selectable direction means comprises a rotatable valve member having a hollow stem and an oblique oval sealing flange mounted on the stem and the inner tubular part of the barrel has a read end which constitutes a sealed bearing for a front end portion of a stem of the valve member;

proximate said bearing the rear end of the inner tubular part is externally stepped to form a rear terminal portion of increased diameter at which the inner tubular part is joined to the outer tubular part, and said portion of increased diameter is apertured to permit water flow into the outer passage between the two tubular parts;

behind said rear terminal portion of the inner sleeve, the valve stem has a region of increased diameter at which the valve member is located against axial displacement in the barrel, and said increased diameter region of the valve member is also apertured to permit forward water flow, from the aforementioned chamber in the barrel behind it, into an intermediate space from which the water can enter the apertures in the increased diameter portion of the inner tubular part of the barrel.

2. A water spray gun according to claim 1, in which the two discharge areas of the nozzle means respectively include means for producing a water spray and means for producing a generally unidirectional jet.

3. A water spray gun according to claim 2, in which the means for producing a generally unidirectional jet comprises means defining a central jet-producing aperture means and the means for producing a water spray comprises a spray-producing perforated plate which surrounds said central jet producing aperture means.

4. A water spray gun according to claim 3, in which the selectable direction means comprises a rotatable valve member in the barrel and connected to the control element, wherein the control element is rotationally adjustable to rotate the valve member to select a chosen one of the water flow passages to which water is directed.

5. A water spray gun according to claim 4, in which the water flow passages in the barrel comprise a central water flow passage for the jet-producing aperture means and a surrounding principally annular water flow passage for the spray-producing perforated plate.

6. A water spray gun according to claim 5, in which the control element is integrally formed with the valve member.

7. A water spray gun according to claim 5, in which the valve member comprises a stem which is hollow so as to define a central feed passage which communicates with said central water flow passage; an oblique oval flange which is carried by the stem and which seals against the inside of the barrel, the flange, the barrel and the stem defining a feed chamber which communicates with said annular water flow passage; means defining a port in a part of the stem outside said feed chamber which post communicates with said central feed passage, the valve member being situated adjacent means defining an entry port through which water is admitted to the barrel, the valve member being rotatable between a first operative position in which water from the entry port travels into the port in the valve stem and a second operative position in which water passes from the entry port and into the feed chamber wherein rotation of the valve member from the first to the second operative positions causes the oval seal to traverse the entry port.

8. A water spray gun according to claim 7, in which the first and second operative positions of the control element are defined by stop means formed on the valve member and the interior of the barrel.

9. A water spray gun according to claim 8, in which generally midway between the two operative positions, the oblique oval sealing flange lies across the entry port.

10. A water spray gun according to claim 1, in which the nozzle means also comprises an inner tubular part and an outer tubular part, said inner tubular part fitting, by means of cooperating screwthreads, over the front end of the inner tubular part of the barrel and said outer tubular part fitting sealingly within the outer tubular part of the barrel.

* * * * *